US007850285B2

(12) United States Patent
Yoshihira et al.

(10) Patent No.: US 7,850,285 B2
(45) Date of Patent: Dec. 14, 2010

(54) LIQUID JETTING HEAD, METHOD FOR CHANGING PROTECTIVE TAPE IN ADHESIVE STRENGTH, AND PROTECTIVE TAPE

(75) Inventors: Aya Yoshihira, Yokohama (JP); Takeshi Okazaki, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 890 days.

(21) Appl. No.: 11/745,128

(22) Filed: May 7, 2007

(65) Prior Publication Data

US 2007/0263034 A1 Nov. 15, 2007

(30) Foreign Application Priority Data

May 9, 2006 (JP) ..... 2006-130789

(51) Int. Cl.
*B41J 2/05* (2006.01)

(52) U.S. Cl. ..... 347/65

(58) Field of Classification Search ..... 347/56–59, 347/61–65, 67, 50, 40, 44, 45, 47, 49, 20, 347/87; 438/118; 29/890.1, 25.35
See application file for complete search history.

(56) References Cited

U.S. PATENT DOCUMENTS

| | | | | |
|---|---|---|---|---|
| 5,262,802 | A | 11/1993 | Karita et al. | |
| 5,781,208 | A | 7/1998 | Karita et al. | |
| 5,850,238 | A | 12/1998 | Karita et al. | |
| 6,715,865 | B2 * | 4/2004 | Yamaguchi et al. | 347/87 |
| 2005/0248640 | A1 * | 11/2005 | Ward et al. | 347/87 |
| 2008/0259119 | A1 * | 10/2008 | Ikegame et al. | 347/40 |
| 2009/0128602 | A1 * | 5/2009 | Goto et al. | 347/45 |

FOREIGN PATENT DOCUMENTS

| | | |
|---|---|---|
| JP | 3-234659 | 10/1991 |
| JP | 2003-266720 | 9/2003 |

* cited by examiner

*Primary Examiner*—K. Feggins
(74) *Attorney, Agent, or Firm*—Fitzpatrick, Cella, Harper & Scinto

(57) ABSTRACT

A liquid ejecting head includes an ejection side surface; an ejection outlet, formed in the ejection side surface, for ejecting liquid; and a protection tape pasted on the ejection side surface. The protection tape is partly irradiated with ultraviolet radiation or infrared radiation after being pasted on the ejection side surface such that bonding strength is different depending on a position of the protection tape.

15 Claims, 7 Drawing Sheets

(a)

(b)

LIQUID JETTING HEAD, METHOD FOR CHANGING PROTECTIVE TAPE IN ADHESIVE STRENGTH, AND PROTECTIVE TAPE

FIELD OF THE INVENTION AND RELATED ART

The present invention relates to a liquid jetting head, whose liquid jetting orifices are protected with tape, a method for bonding the tape for protecting a liquid jetting head, and tape for protecting a liquid jetting head.

In recent years, computer usage has widely spread. With the spread of computer usage, an ink jet recording apparatus, that is, a recording apparatus which jets ink droplets from its ink jetting orifices, has come to be widely used as an inexpensive and highly precise printing means. Some ink jet recording apparatuses have recording heads which are removably mountable in their main assemblies. When an ink jet recording apparatus is in use, the openings of its ink jetting orifices must be open to allow ink to be jetted from the ink jetting orifices. After a recording head is manufactured, it is packaged, shipped, and stored on a store shelf until it is purchased by a user. Thus, if the openings of the ink jetting orifices of an ink jet head are not covered (sealed) with a protective member, they remain exposed to ambient air for a long time before the user begins to use the recording head by unsealing the package. Thus, it is possible that before the user begins to use the recording head, diminutive debris floating in the ambient air will enter the ink jetting orifices and adversely affect the ink jetting performance of the recording head. Further, in the case of an ink jet cartridge, which is an integral combination of a recording head (ink jet recording heads) and an ink container (ink containers), the solvent portion of the ink in the ink jetting orifices evaporates, and the evaporation of the solvent increases the viscosity of ink in the ink jetting orifices, or sometimes will leave the other ingredients of the ink solidified, and plug up the ink jetting orifices, before the ink jet cartridge is put to use for the first time. Therefore, unless the openings of the ink jetting orifices of an ink jet cartridge are covered (sealed) at the end of its manufacture, it is possible that the ink jetting orifices of the ink jet cartridge will plug up. It is also possible that the vibrations which occur during the shipment of an ink jet cartridge will cause the ink in the ink jetting orifices to scatter by being shaken out of the nozzles.

In order to solve the problems described above, the openings of the ink jetting orifices of an ink jet recording head are protected and sealed by protective tape. Some of the conventional protective tapes (protective tapes in accordance with prior art) are adhesive films for protecting and sealing the openings of the ink jetting orifices of an ink jet head, for example, the adhesive protective film disclosed in Japanese Laid-open Patent Application 3-234659.

It has been proposed to fabricate protective tape so that portions of protective tape, which correspond in position and shape to the openings of the ink jetting orifices of an ink jet head, are left without adhesive, as disclosed in Japanese Laid-open Patent Application No. 2003-266720.

In recent years, the desire has become stronger to record an image, which is much higher in precision than an image recordable with the use of a conventional ink jet recording apparatus. Thus, the recording head for an ink jet recording apparatus has come to require a further reduction in the amount by which ink is jetted from each of its ink jetting orifices, in order to increase the recording head resolution. The amount by which ink is jetted from an ink jetting orifice is determined by the distance between an element, such as a heater, for generating the energy for jetting ink, and the corresponding nozzle through which ink is jetted. Thus, in the past, in order to increase an ink jet head resolution by reducing the amount by which ink is jetted from each ink jetting orifice of the ink jet head, it was necessary to reduce in thickness the substrate in which the ink jetting orifices are formed. Therefore, in recent years, the mechanical strength of a recording head has been declining, making it possible that when the protective tape which is on an ink jet head to protect (keep sealed) the openings of its ink jetting orifices is peeled away from the recording head, the recording head will be damaged by the adhesive strength (peel resistance) of the adhesive on the protective tape.

Further, it is desired to further increase an ink jet recording apparatus in recording speed and also to further reduce its size. In order to further increase an ink jet recording apparatus recording speed, while reducing its size, it is necessary to further reduce an ink jet head's ink droplet size, and also, to increase an ink jet head's density of its ink jetting orifices, and its length. Therefore, the resin layer on the substrate which has driving elements, including the elements for generating the energy for jetting ink, more specifically, the resin layer through which ink jetting orifices are formed, has to be further reduced in thickness. The reduction of the thickness of the resin layer increases in void ratio the portion of the resin layer of the ink jet head, which has the ink jetting orifices. Therefore, it is possible that an ink jet head would further reduce in mechanical strength. Thus, the possibility that when a protective tape which is on an ink jet recording head, such as the one described above, to protect the openings of the ink jetting orifices of the recording head, is peeled, that the portions of the recording head, which have the ink jetting orifices and are far weaker than those of a conventional ink jet recording apparatus, will be damaged, is even higher.

As one of the countermeasures to the above described problems, it is possible to reduce the protective tape in adhesive strength. However, simply reducing the protective tape in adhesive strength, that is, reducing the entire adhesive area of the protective tape in adhesive strength, possibly makes it impossible to completely seal each of the ink jetting orifices. Thus, if the protective tape is simply reduced in adhesive strength, it is possible that the inks which are different in color come out of the ink jet head into the gaps which occur between the surface of the ink jet head, which has the openings of the ink jetting orifices, and the protective tape, and mix in these gaps. Thus, an ink jet recording head which contains multiple inks different in color suffers from the problem that it is difficult to keep completely separated the multiple inks, different in color.

As another countermeasure to the above described problems, it is possible to manufacture protective tape so that the portion of the tap, which correspond in shape and position to the portions of a recording head, which are relatively low in mechanical strength, are not provided with adhesive layer. However, this solution also has a problem. That is, if a resinous substance is used as the material for the substrate of the protective tape, the resultant protective tape stretches or shrinks. Thus, if the protective tape is subjected to external force when it is pasted to a recording head, it deforms in response to the external force, no matter how small the external force. Thus, the protective tape of this type is difficult to precisely paste to an ink jet recording head; it is difficult to paste the protective tape of this type to an ink jet recording head so that the abovementioned portions of the adhesive surface of the protective tape, which are not provided with adhesive, align, one for one, with the openings of the ink jetting orifices of the recording head.

SUMMARY OF THE INVENTION

The present invention was made in consideration of the problems described above, and therefore, the primary object of the present invention is to provide: a liquid jetting head which is not damaged when the protective tape on the liquid jetting head is peeled away from the head. Another object of the present invention is to provide a method for adhering protective tape to such an ink jet head, and protective tape for protecting such an ink jetting head.

According to an aspect of the present invention, there is provided a liquid ejecting head comprising an ejection side surface; an ejection outlet, formed in said ejection side surface, for ejecting liquid; a protection tape pasted on said ejection side surface, wherein said protection tape is partly irradiated with ultraviolet radiation or infrared radiation after being pasted on said ejection side surface such that bonding strength is different depending on a position of said protection tape.

The present invention makes it possible to change the adhesive strength of the protective tape on a liquid jetting head, based on location. Therefore, it is possible to provide a liquid jetting head having such a protective tape, which is relatively lower in adhesive strength across the portions which correspond in shape and position to the portions of the liquid jetting head, which are inferior in mechanical strength, and relatively high in adhesive strength across the rest. The present invention also makes it possible to provide an ink jet cartridge, that is, an integrated combination of a liquid jetting head and an ink container, which has the protective tape described above, and the protective tape described above. Further, the present invention can provide a method for pasting the above described protective tape for protecting a liquid jetting head, to a liquid jetting head. Therefore, the present invention can prevent the problem that when protective tape is peeled away from a liquid jetting head, the portions of the liquid jetting head, which are inferior in mechanical strength, are damaged by the adhesive strength of the adhesive of the protective tape.

Further, the present invention makes it possible to make relatively high in adhesive strength the portions of the protective tape, which correspond in shape and position to the portions of the liquid jetting head, which are next to the ink jetting orifices of the liquid jetting head. Therefore, the present invention can prevent ink from coming out any of the ink jetting orifices of a liquid jetting head before the ink jetting head is used for the first time. In other words, the present invention can prevent the problem that before a liquid jetting head is used for the first time, ink comes out of an ink jetting orifice of the liquid jetting head, enters another liquid jetting orifice which jets ink different in color from the ink jetted by the first ink jetting orifice, and mixes with the ink in the second ink jetting orifice. Therefore, the present invention can provide a liquid jetting head which is superior to a conventional liquid jetting head (liquid jetting head in accordance with prior art) in that its protective tape is better in keeping separated the inks in the ink jetting head, which are different in color, before the ink jetting head is used for the first time.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Hereinafter, the preferred embodiments of the present invention will be described in detail with reference to the appended drawings. First, the first preferred embodiment of the present invention will be described with reference to FIGS. 1-4.

Figure 1:
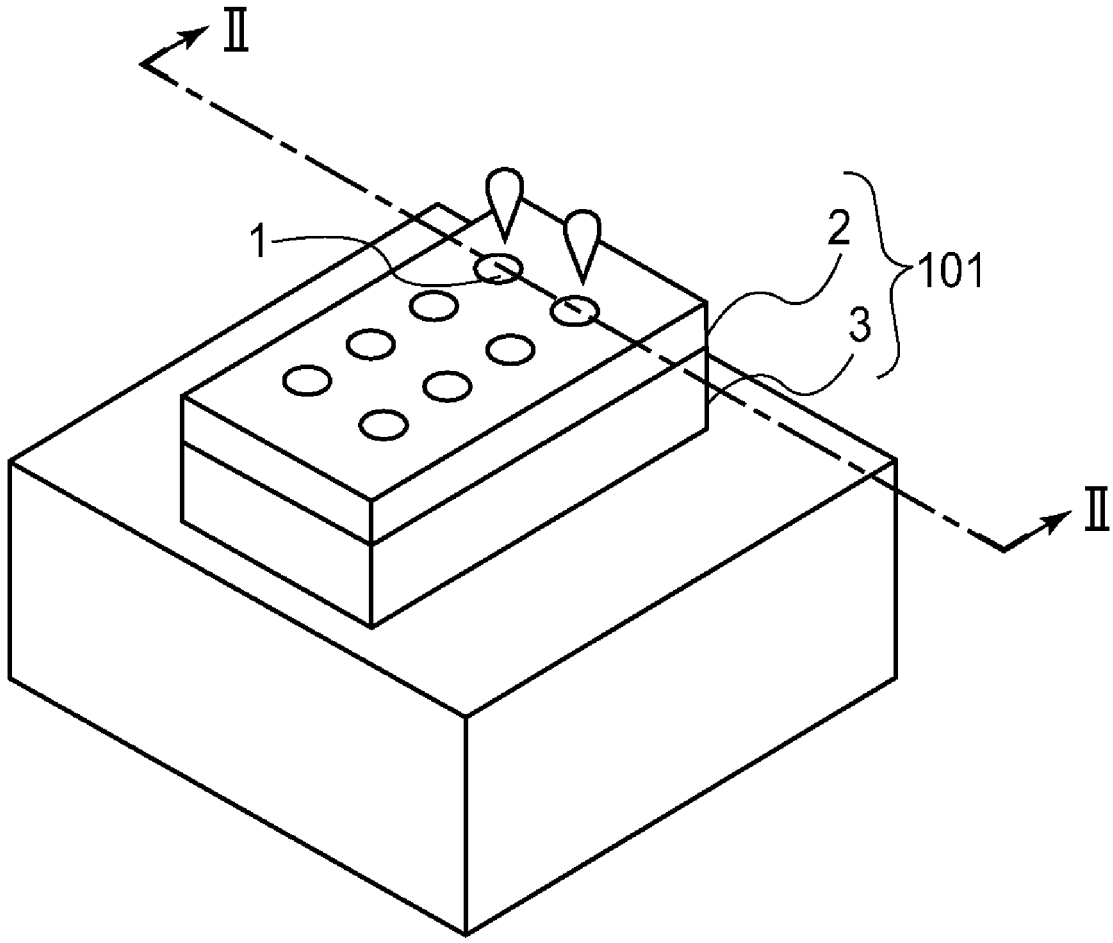
FIG. 1 is a schematic perspective view of the recording head in the first embodiment of the present invention.
Figure 2:
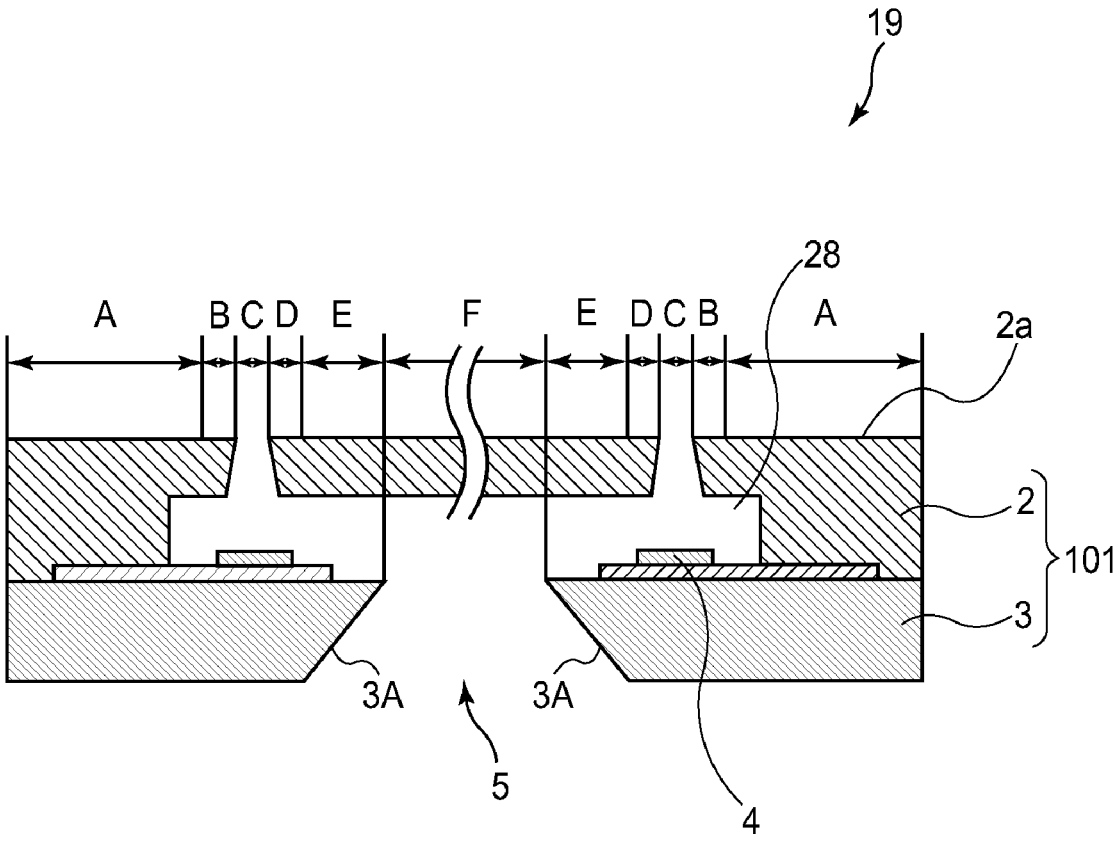
FIG. 2 is a sectional view of the recording head in FIG. 1, at Line II-II in FIG. 1.

FIGS. 1-4 are drawings of one of the typical recording apparatuses to which the present invention is applicable. FIGS. 1-4 are schematically drawn for describing the present invention; the number of ink jetting orifices or the like is different from that of the actual recording head. FIG. 1 is a schematic perspective view of the recording head 101 (liquid jetting head), and FIG. 2 is an enlarged sectional view of the ink jetting orifices of the recording head 101 in FIG. 1, and their adjacencies, at Line II-II in FIG. 1.

Referring to FIGS. 1 and 2, the ink jet recording head 101 in this embodiment has a silicon substrate 3, and a top plate 2 which is on the silicon substrate 3. It has a common liquid chamber 5, which is a hollow located centrally in the substrate 3. The common liquid chamber 5 is shaped so that its cross section tapers narrower toward the top plate 2. The ink jetting recording head 101 also has an ink passage 28 (liquid passage), which is in the center portion of the top plate 2. The ink passage 28 is wider than the common liquid chamber 5, and is in connection with the common liquid chamber 5. Because the ink passage 28 is wider than the common liquid chamber 5, a portion 3A of the silicon substrate 3 protrudes toward the center of the ink jetting recording head 101, relative to the inward bottom edge of the ink passage 28, on each side of the ink jetting recording head 101, in terms of the direction perpendicular to the direction in which the ink jetting orifices are aligned. There are heat generating elements 4 on the protruding portions 3A of the silicon substrate 3. The driving elements which have the heat generating elements 4 and the wiring for driving the heat generating elements are formed by photolithographic technologies. Further, the top plate 2 has the ink jetting orifices 1 from which liquid can be jetted. The ink jetting orifices 1 are right above the heat generating elements 4, one for one, with the presence of the ink passage 28 between the orifices 1 and heat generating elements 4. The common liquid chamber 5 and ink passage 28 are indirectly in connection to the outside of the recording head 101 through the ink jetting orifices 1. Ink is supplied to the ink passage 28 from the common liquid chamber 5. As a driving signal is given to any of the heat generating elements 4 in the ink passage 28, heat is generated by the heat generating element 4, and this heat causes the ink in the ink passage 28 to boil; the heat generates a bubble (bubbles) in the ink. As a result, a part of the body of ink in the ink passage 28 is jetted out of the corresponding ink jetting orifice 1 by the pressure from the bubble.

The common liquid chamber 5 is formed by anisotropically etching the silicon substrate 3 in a manner to penetrate the silicon substrate 3. The ink for printing is delivered from an unshown ink supplying member, into the ink passage 28, which is in connection to the ink jetting orifices 1, through the common liquid chamber 5.

Designated by a referential character 2*a* in FIG. 2 is the top surface of the top plate 2, which has the openings of the ink jetting orifices, and designated by referential characters A-F are various areas of the top surface 2*a* of the top plate 2. The area F is in alignment with the top opening of the common liquid chamber 5, with the presence of the ink passage 28 between the area F and the opening of the common liquid chamber 5. The area C coincides with the opening of the corresponding ink jetting orifice. The areas B and D are the areas of the top surface 2*a*, which are next to the opening of the corresponding ink jetting orifice. The area E is the area of the top surface 2*a*, which is between the areas D and F, and the area A is the area of the top surface 2*a*, which is outside the area B.

Figure 3:
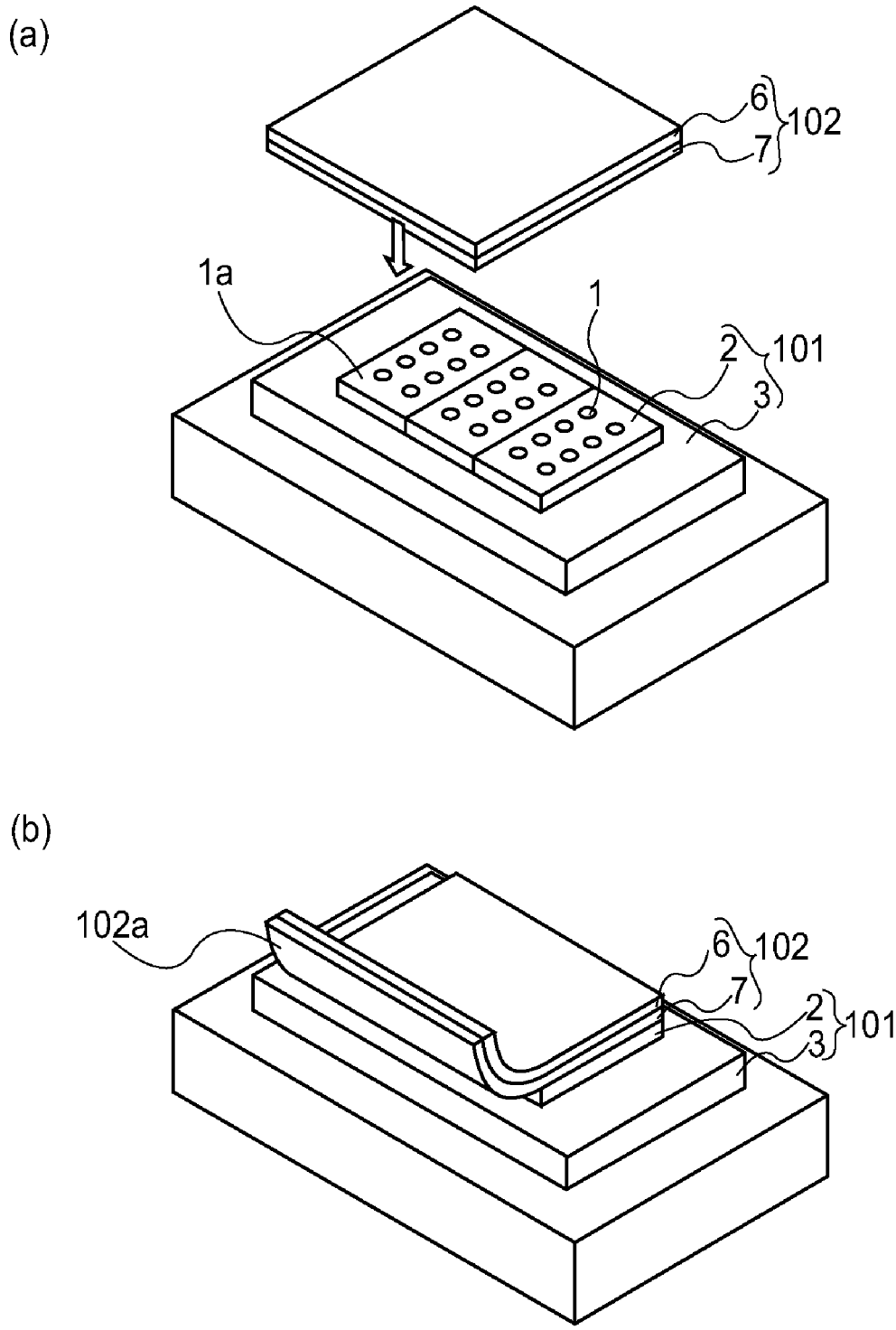
FIG. 3 is a perspective view of the recording head and protective tape in the first embodiment of the present invention, showing how the protective tape is pasted to the recording head, in the first embodiment.

FIGS. 3(*a*) and 3(*b*) are perspective views of the protective tape 102 and recording head 101. FIGS. 3(*a*) and 3(*b*) show the states of the protective tape 102 and recording head 101 before and after, respectively, the pasting of the protective tape 102 to the recording head 101. In this embodiment, the protective tape 102 is made up of a substrate 6 formed of 25 μm thick polyethylene-terephthalate, and a roughly 10 μm thick layer of adhesive 7 coated on the substrate 6. The adhesive 7 is an acrylic adhesive produced by radical polymerization, and can be reduced in adhesive strength (peel resistance) by exposing it to ultraviolet rays. The recording head 101 in this embodiment is provided with three top plates 2, which are different in the color of the ink which is jetted through their ink jetting orifices.

Referring to FIG. 3(*b*), the protective tape 102 is pasted to the top surface 2*a* of the top plate 2 of the ink jet recording head 101, shown in FIG. 2, which has the openings of the ink jetting orifices. Next, referring to FIGS. 3(*a*) and 3(*b*), the protective tape 102 is rectangular, and in terms of the direction parallel to the direction in which the ink jetting orifices are arranged, the dimension of the protective tape 102 is greater than that of the surface 2*a*. In other words, the protective tape 102 is provided with a portion 102*a*, which is not pasted to the recording head 101. This portion 102*a*constitutes a tab to be grasped when pulling the protective tape 102 to peel the protective tape 102 away from the recording head 101.

It is presumed here that the portion 102*a* (tab) is also coated with the adhesive 7, on the same side as the surface of the rest of the protective tape 102, which is coated with the adhesive 7. However, this portion 102*a* (tab) does not need to be coated with the adhesive 7; it is only the portion of the surface of the protective tape 102, which comes into contact with the recording head 101, that needs to be coated with the adhesive 7.

Figure 4:
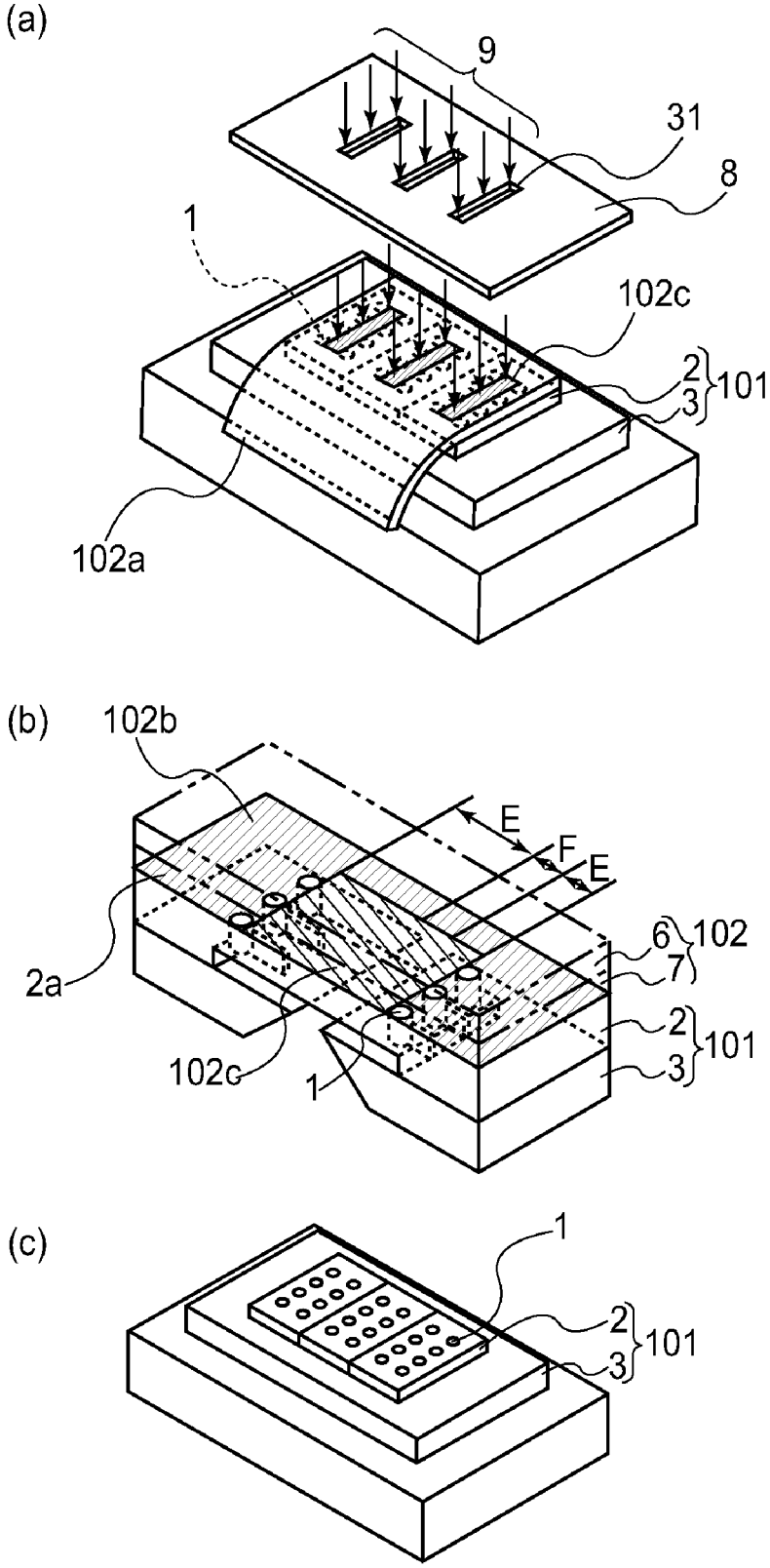
FIGS. 4(*a*)-4(*c*) are perspective views of the recording head, protective tape, and mask in the first embodiment, showing how the protective tape is made nonuniform in adhesive strength after being pasted to the recording head as shown in FIG. 3.

FIG. 4 shows the method for making the preselected portions of the protective tape 102 different in adhesive strength from the rest of the protective tape 102. FIG. 4(*a*) is a perspective view of the recording head 101, the protective tape 102 on the recording head 101, and a mask 8. FIG. 4(*b*) is a perspective view of the recording head 101 and the protective tape 102 on the recording head, in which the liquid jetting orifices, and their adjacencies, are exaggerated to clearly show the distinction between the portion of the protective tape 102, which is greater in adhesive strength, and the portion of the protective tape 102, which is less in adhesive strength. FIG. 4(*c*) is a perspective view of the recording head 101, and shows how the recording head 101 appears after the peeling of the protective tape 102 therefrom.

In this embodiment, first, the protective tape 102 is positioned, as shown in FIG. 3(*a*), so that it aligns with the recording head 101 to which it is to be adhered. The surface of the substrate 6 of the protective tape 102, which will be on the recording head side after the pasting of the protective tape 102 to the recording head 101, has the layer of acrylic adhesive 7 formed by radical polymerization, with which the surface has been coated in advance. Then, the protective tape 102 is pasted to the recording head 101 as shown in FIG. 3(*b*). Thereafter, the mask 8 is placed on the protective tape 102 on the recording head 101, being aligned with the recording head 101 as shown in FIG. 4(*a*). The mask 8 is provided with a preset number (three in this embodiment) of slits 31 (openings), which correspond in shape and position to the portions of the protective tape 102, which need to be reduced in adhesive strength. The mask 8 is formed of a substance which blocks ultraviolet rays. Therefore, as ultraviolet rays are irradiated upon the protective tape 102 with the presence of the mask 8 on the protective tape 102, the protective tape 102 is partially exposed to the ultraviolet rays.

The protective tape on the recording head 101 is covered with the mask 8, that is, the mask having the slits 31 which correspond in shape and position to the portions 102*c* of the protective tape, that is, the portions which need to be reduced in adhesive strength. Then, the protective tape is irradiated with ultraviolet rays 9, with the mask 8 remaining on the protective tape. Thus, the ultraviolet rays 9 are allowed to hit only the portions 102*c* of the protective tape, that is, the portions which correspond in shape and position to the slits 31 of the mask 8 one for one. As the ultraviolet rays 9 hit the portions 102c of the protective tape 102, that is, the portions which correspond in shape and position to the slits 31 of the mask 8, one for one, the layer of the adhesive 7, which is on the bottom side of each of the portions 102*c*, reduces in adhesive strength. On the other hand, the portions of the mask 8, which do not have the slits 31, block the ultraviolet rays 9, preventing thereby ultraviolet rays 9 from reaching the protective tape 102. Thus, the rest of adhesive layer 7, which is on the bottom side of the portion of the protective tape 102, other than the portions which correspond to the slits 31, remains the same in adhesive strength. As a result, the portions 102*c* (hatched with slanted lines in FIG. 4(*a*)) of the protective tape 102, which correspond to the slits 31 of the mask 8, become weaker in adhesive strength relative to the rest of the protective tape 102; the portion of the protective tape 102, which corresponds to the portions (hatched with slanted lines in FIG. 4(*b*)) of the mask 8, which do not have the slits 31, remains the same in adhesive strength, being therefore greater in adhesive strength relative to the portions 102*c* of the protective tape 102.

The protective tape 102 is pasted to the surface 2*a* of the top plate 2 of the recording head 101, which has the openings of the ink jetting orifices, as outlined by a dotted line in FIG. 4(*b*). The diagonally hatched areas 102*c* (FIG. 4(*a*)) of the top surface 2*a* of the top plate 2, which has the openings of the ink jetting orifices, are less in mechanical strength, because there is the ink passage 28 below them. The portions 102*c* which correspond one for one to the slits 31, correspond to the areas E and F shown in FIG. 2, and the portion 102*b* of the protective tape 102, which corresponds to the portion of the mask 8, which does not have the slits 31, correspond to the areas A, B, C, and D shown in FIG. 2. That is, the slits 31 of the mask 8 are shaped and positioned so that as the mask 8 is properly positioned relative to the recording head 101, the slits 31 align with the areas of the top surface 2*a* of the top plate 2, which are next to the openings of the ink jetting orifices, and correspond in position to the ink passage 28.

Before the ink jet cartridge is used for the first time, the protective tape 102 is to be peeled away to make the recording head 10 appear as shown in FIG. 4(*c*), so that the recording head 101 can be used with the openings of its ink jetting orifices exposed. The portions of the protective tape 102, which correspond in shape and position to the slits 31 of the mask 8, are relatively weaker in adhesive strength, compared to the rest of the protective tape 102. Therefore, the portions of the recording head 101, which correspond to the areas E and F, shown in FIG. 2, and which are lower in mechanical strength, are not damaged when the protective tape 102 is peeled.

The adhesive 7 in this embodiment is an acrylic adhesive produced by radical polymerization. However, the adhesive 7 does not need to be an acrylic adhesive produced by radical polymerization. That is, all that is necessary is that the material for the adhesive layer is formed of such an adhesive substance that reduces in adhesive strength (peel resistance) as it is irradiated with ultraviolet rays. The intensity (amount) of the ultraviolet rays 9 irradiated upon the protective tape 102 is 600 mJ/cm$^2$ (luminance at wavelength of 365 nm), for example. However, the conditions for irradiating the protective tape 102 with the ultraviolet rays 9, such as the intensity of the ultraviolet rays 9 or the length of irradiation time, may be adjusted according to the ambient conditions and type of adhesive. Further, the light to which the protective tape 102 is to be exposed does not need to be ultraviolet rays. Any type of light (electromagnetic wave) may be used in place of ultraviolet rays, as long as the selected light is capable of reducing in adhesive strength the adhesive used as the material for the adhesive layer of the protective tape 102.

Further, the recording head 101 may be the recording head portion of an ink jet cartridge, that is, an integral combination of an ink container and a recording head.

In this embodiment, the portions 102*c* of the protective tape 102, which are on the areas A and B of the top surface 2*a* of the top plate 2, which include the areas B and D, are left unchanged in adhesive strength, remaining therefore relatively higher in adhesive strength. From the standpoint of preventing ink from spilling out of the ink jetting orifices 1, it is desired that the portions of the protective tape 102, which are on the portions of the top surface 2*a*, which are next to the opening of the ink jetting orifices, are left unchanged in adhesive strength, because with the portions of the protective tape 102, which are on the portions of the top surface 2*a*, which are next to the opening of the ink jetting orifices, left unchanged in adhesive strength, it is unlikely that the ink in a given ink jetting orifice 1 will come out of the nozzle 1, enter the ink jetting orifice which is different in the color of the ink therein, and mix with the ink in this jetting nozzle. In other words, the present invention can provide an ink jet recording head which is superior to an ink jet recording head in accordance with the prior art, from the standpoint of keeping separated the inks in an ink jet recording head before the ink jet recording head is used for the first time. It also can provide an ink jet cartridge, that is, an integral combination of an ink jet head and an ink container, which is superior to an ink jet cartridge in accordance with the prior art, from the same standpoint.

Embodiment 2

Figure 5:
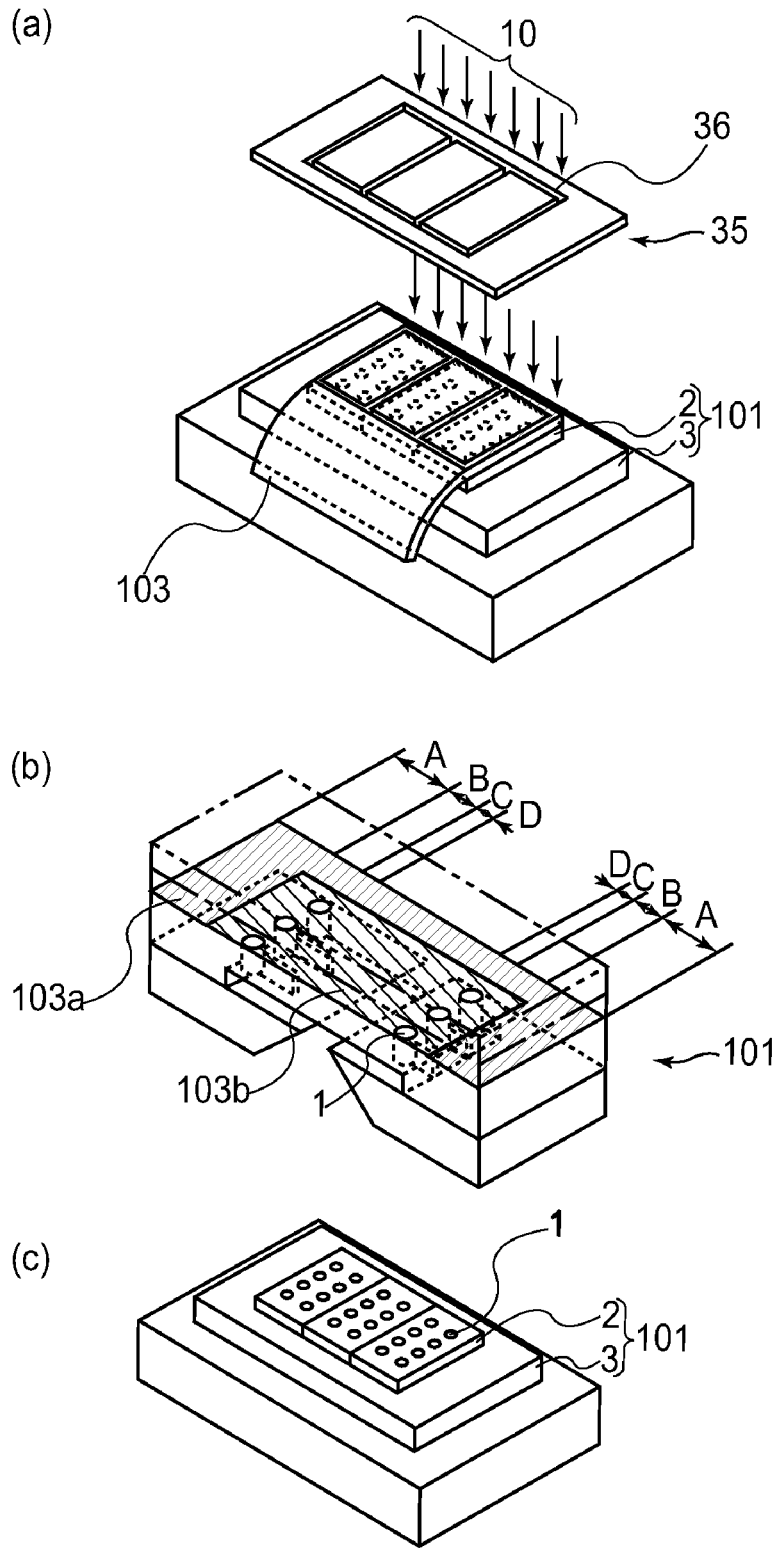
FIGS. 5(*a*)-5(*c*) are perspective views of the recording head, protective tape, and mask in the second embodiment, showing how the protective tape is made nonuniform in adhesive strength after being pasted to the recording head.

FIG. 5 is a drawing which depicts the second embodiment of the present invention. FIG. 5(*a*) is a perspective view of a mask 35, a protective tape 103, and a recording head 101. The protective tape 103, in this embodiment, is pasted to the surface of the recording head 101, which has the openings of the ink jetting orifices of the recording head 101. FIG. 5(*b*) is a perspective view of the recording head 101 and the protective tape 103 on the recording head, in which the liquid jetting orifices, and their adjacencies, are exaggerated to clearly show the distinction between the portion 103*b* of the protective tape 103, which is greater in adhesive strength, and the portions 103*a* of the protective tape 103, which are less in adhesive strength. FIG. 5(*c*) is a perspective view of the recording head 101, and how the recording head 101 appears after the peeling of the protective tape 103.

The protective tape 103 in this embodiment is pasted to the recording head 101 using the following method: First, the protective tape 103 is positioned above the recording head 101, as shown in FIG. 5(*a*), so that it properly aligns with the recording head 101. The mask 35 is provided with slits 36 (opening), which are preset in shape and position. The slits 36 of the mask 35 correspond in position and shape to the portions of the protective tape 103, which need to be increased in adhesive strength. The mask 35 is formed of a substance which blocks infrared rays. The protective tape 103 is manufactured so that before the protective tape 103 is irradiated with infrared rays 10, its adhesive strength is on the relatively low side. This will be described later in more detail.

After the placement of the mask 35 with the slits 36 on the recording head 101, the recording head 101 is irradiated with the infrared rays 10 with the mask 35 remaining on the recording head 101 (on protective tape 103). The infrared rays 10 are allowed to reach the protective tape 103 only through the slits 36 of the mask 35. Therefore, the protective tape 103 is exposed to the infrared rays 10 only across the portions which correspond to the slits 36. As the infrared rays 10 are projected upon the recording head 101, the adhesive layer of the protective tape 103 increases in adhesive strength only across the portions which correspond to the slits 36, that is, the diagonally hatched portion 103*a* shown in FIG. 5(*b*). On the other hand, the rest of the protective tape 103, that is, the diagonally hatched portion 103*b* shown in FIG. 5(*b*), or the portion which does not correspond to the slits 36, remains the same in adhesive strength, because the material for the mask 35 blocks infrared rays 10, and therefore, the infrared rays 10 do not reach this portion of protective tape 103. In other words, the portion 103*b* remains relatively weak in adhesive strength. With the use of the above described method, the protective tape 103 on the recording head 101 can be processed so that only the hatched portion 103*a* of the protective tape 103, that is, the portion which corresponds in shape and position to the slits 36 of the mask 35, increases in adhesive strength, whereas the hatched portion 103*b* of the protective tape 103, that is, the portion which does not correspond to the slits 36 of the mask 35, remains relatively weak in adhesive strength. FIG. 5(*b*) shows the recording head 101 after the processing of the protective tape 103 on the recording head with the use of the above described method.

Prior to the first time usage of the recording head 101, the protective tape 103 is peeled away to expose the opening of each of the ink jetting orifices, in order to make the recording head 101 appear as shown in FIG. 5(*c*). The recording head 101 is used with the opening of each of the ink jetting orifices kept open.

The protective tape 103 in this embodiment is made up of a 20 μm thick substrate layer formed of polypropylene, and a 15 μm thick layer of acrylic adhesive coated on the substrate layer. However, the material for the substrate layer and material for the adhesive layer do not need to be limited to the abovementioned ones. That is, substances other than the abovementioned ones may be used as the materials for the substrate layer and adhesive layer of the protective tape 103, as long as the substances selected as the materials therefor are such that as the protective tape 103 is irradiated with the infrared rays 10, the protective tape 103 increases in adhesive strength. The intensity (amount) of the infrared rays 10 irradiated upon the protective tape 103 is 600 mJ/cm$^2$ (luminance at wavelength of 700 nm), for example. However, the conditions for irradiating the protective tape 103 with the infrared rays 10, such as the intensity of the infrared rays 10 or the length of irradiation time, may be adjusted according to the ambient conditions and type of adhesive. Further, the light to which the protective tape 103 is to be exposed does not need to be infrared rays. That is, any type of light (electromagnetic wave) may be used in place of infrared rays, as long as the selected light is capable of increasing in adhesive strength the substance used as the material for the adhesive layer of the protective tape 103, by exciting the substance.

With the use of the above described protective tape 103 and the above described method for pasting the protective tape 103 to the recording head 101, it is possible to prevent the problem that when the protective tape 103 is peeled from the recording head 101, the portions (which correspond to areas E and F in first embodiment) of the recording head 101, which are relatively weak in mechanical strength, are damaged by the adhesive strength (peel resistance) of the adhesive on the protective tape 103.

In this embodiment, only the portion 103*a* of the protective tape 103, that is, the portion which corresponds to the area A in the first embodiment, is increased in adhesive strength, and the portion 103*b*, that is, the portion which corresponds to the area C, is left unchanged in adhesive strength, that is, left relatively low in adhesive strength. Provided that the it is permissible that a small amount of ink leaks from an ink jet recording apparatus through its ink jetting orifices, the protective tape may be processed so that the protective tape is changed in adhesive characteristic as in this embodiment, after the pasting of the protective tape to a recording head.

Embodiment 3

Figure 6:
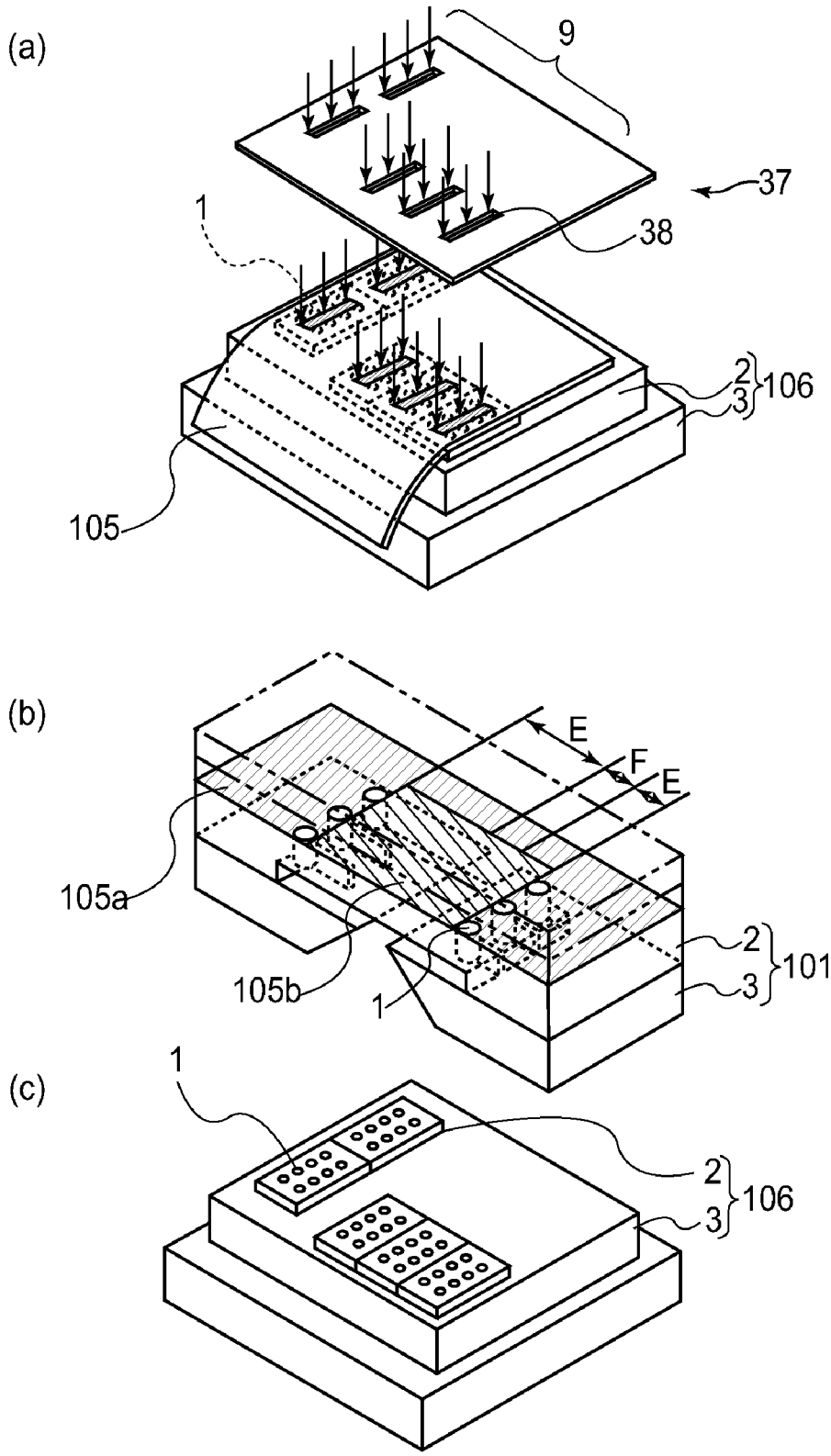
FIGS. 6(*a*)-6(*c*) are perspective views of the recording head, protective tape, and mask in the third embodiment, showing how the protective tape is made nonuniform in adhesive strength after being pasted to the recording head.

FIG. 6 is a drawing which depicts the third embodiment of the present invention. FIG. 6(*a*) is a perspective view of the mask 37, protective tape 105, and recording head 106. The protective tape 105 is pasted to the surface of the recording head 106, which has the openings of the liquid jetting orifices. FIG. 6(*b*) is a perspective view of the recording head 106 and the protective tape 105 on the recording head, in which the liquid jetting orifices, and their adjacencies, are exaggerated to clearly show the distinction between the portion 105*a* of the protective tape 105, that is, the portion next to the liquid jetting orifices, which is greater in adhesive strength, and the portions 105*b* of the protective tape 103, that is, the rest, which are less in adhesive strength. FIG. 6(*c*) is a perspective view of the recording head 106, and how the recording head 106 appears after the peeling of the protective tape 105.

The protective tape 105 in this embodiment is pasted to the recording head 106 using the following method: First, the protective tape 105 is pasted to the recording head 106. Then, a mask 37 is placed on the protective tape 105 on the recording head 106. More specifically, the mask 37 is provided with slits 38 which correspond in shape and position to the portions of the protective tape 105, which need to be reduced in adhesive strength. Thus, the mask 37 is placed on the protective tape 105 on the recording head 106 so that its slits 38 align with the portions of the protective tape 105, which need to be reduced in adhesive strength, as shown in FIG. 6(*a*). The mask 37 is formed of a substance which blocks ultraviolet rays. The protective tape 105 is manufactured so that before the protective tape 105 is irradiated with ultraviolet rays 10, its adhesive strength is on the relatively high side. This will be described later in more detail.

After the placement of the mask 37 on the recording head 106, the recording head 106 is irradiated with the ultraviolet rays 9 with the mask 37 remaining on the recording head 106 (on protective tape 105). The ultraviolet rays 9 are allowed to reach the protective tape 105 only through the slits 38 of the mask 37. Therefore, the protective tape 105 is exposed to the ultraviolet rays 9 only across the portions, which correspond to the slits 38. As the ultraviolet rays 9 are projected upon the recording head 106, the adhesive layer of the protective tape 105 decreases in adhesive strength only across the portions which correspond to the slits 38, that is, the diagonally hatched portion 105*b*. On the other hand, the rest of the protective tape 105, that is, the diagonally hatched portion 105*b*, or the portion which does not correspond to the slits 38, remains the same in adhesive strength, because the material for the mask 37 blocks ultraviolet rays 9, and therefore, the ultraviolet rays 9 do not reach the portion 105*a* of the protective tape 105. In other words, the portion 105*a* remains relatively higher in adhesive strength. With the use of the above described method, the protective tape 105 on the recording head 106 can be processed so that only the hatched portion 105*b* of the protective tape 105, that is, the portion which corresponds in shape and position to the slits 38 of the mask 37, decreases in adhesive strength, whereas the hatched portion 105*a* of the protective tape 105, that is, the portion which does not correspond to the slits 38 of the mask 37, remains relatively high in adhesive strength. FIG. 6(*c*) shows how the recording head 106 appears after the processing of the protective tape 105 on the recording head 106 with the use of the above described method.

Immediately before the recording head 106 is used in the recording head 106 for the first time, the protective tape 105 is peeled away to expose the opening of each of the ink jetting orifices, as shown in FIG. 6(*c*). The recording head 106 is used with the opening of each of the ink jetting orifices kept exposed. As the material for the substrate layer of the protective tape 105 in this embodiment, 50 μm thick polyester film was used. As the adhesive for the adhesive layer of the protective tape 105, an acrylic adhesive manufactured by radical polymerization was transferred onto the substrate layer of the protective tape 105 to a thickness of roughly 10 μm, as shown in FIG. 6. This protective tape 105 was pasted to the recording head 106. In this embodiment, or the third embodiment, the intensity of the ultraviolet rays 9 (amount of ultraviolet rays irradiation) was 600 mJ/cm$^2$ (luminance at 365 in wavelength).

The recording head 106 in this embodiment is provided with five top plates 2, which have the ink jetting orifices. Referring to FIG. 6(*a*), two of the five top plates 2 are aligned in contact with each other in the direction parallel to the rows of their ink jetting orifices, whereas the other three are aligned in contact with each other in the direction perpendicular to the rows of their ink jetting orifices. Each top plate 2 is different from the other in the ink which they jet. Further, the mask 37 is provided with a total of five slits 38, which correspond to the five top plates 2, one for one.

As the adhesive substance to be coated on the substrate of the protective tape 105, an acrylic adhesive manufactured by radical polymerization was used. However, the adhesive substance to be coated on the substrate of the protective tape 105 does not need to be limited to the abovementioned one. That is, a substance other than the abovementioned one may be used as the material for the adhesive layer of the protective tape 105, as long as the selected substance is such that as the protective tape 105 is irradiated with the ultraviolet rays 9, the protective tape 105 reduces in adhesive strength. In this embodiment, the intensity (amount) of the ultraviolet rays 9 irradiated upon the protective tape 105 is 600 mJ/cm$^2$ (luminance at wavelength of 365 nm), for example. However, the conditions for irradiating the protective tape 105 with the ultraviolet rays 9, such as the intensity of the ultraviolet rays 9 or the length of irradiation time, may be adjusted according to the ambient conditions and type of adhesive. Further, the light to which the protective tape 105 is to be exposed does not need to be ultraviolet rays. That is, any type of light (electromagnetic wave) may be used in place of ultraviolet rays, as long as the selected light is capable of decreasing in adhesive strength the substance used as the material for the adhesive layer of the protective tape 105.

In this embodiment, the protective tape 105 on the recording head 106 can be precisely controlled in adhesive strength. More specifically, the protective tape 105 on the recording head 106 can be processed so that the portions of the protective tape 105, which correspond to the portions of the recording head 106, which are less in mechanical strength (portions equivalent to portions E and F in first embodiment), are reduced in adhesive strength, becoming therefore relatively smaller in adhesive strength, while the rest of the protective tape 105 remains the same in adhesive strength, becoming therefore relatively greater in adhesive strength. Therefore, it is possible to prevent the problem that when the protective tape 105 is peeled from the recording head 106, the portions of the recording head 106, which are relatively inferior in mechanical strength, are damaged by the adhesive strength (peel resistance) of the adhesive on the protective tape 105. Further, the opening of each of the ink jetting orifices remains sealed by the portion of the protective tape 105, which is high in adhesive strength. Therefore, it does not occur that ink comes out of an ink jetting orifice 1. Therefore, it does not occur that the ink in a given ink jetting orifice 1 will come out of the nozzle 1, enter an ink jetting orifice which is different in the color of the ink therein, and mix with the ink in this jetting nozzle. Thus, the ink jet recording head 106, that is, the ink jet recording head in this embodiment, is superior in that the various inks in the recording head remain separated prior to the first time usage of the ink jet recording head.

Embodiment 4

Figure 7:
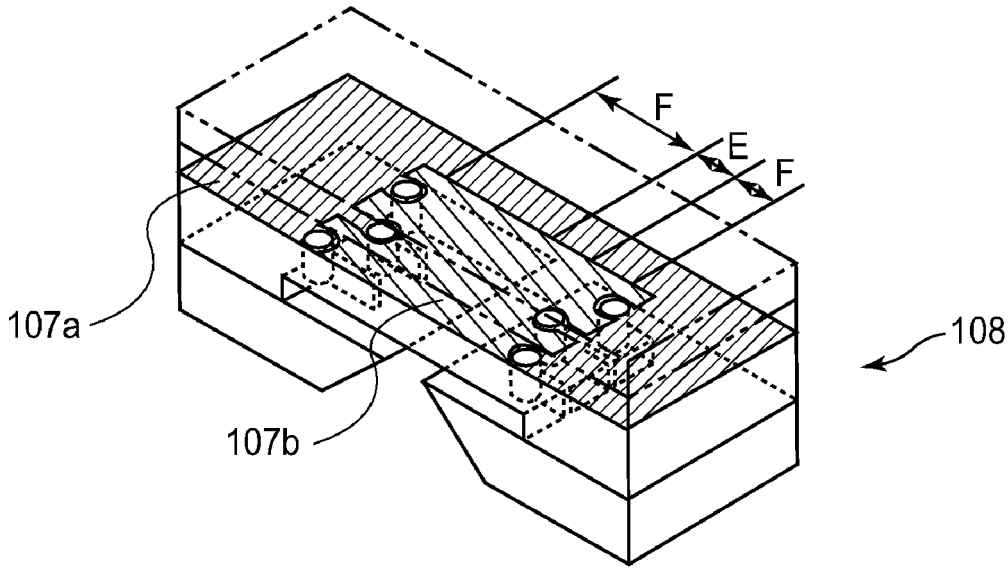
FIGS. 7(*a*)-7(*b*) are perspective views of the recording head, protective tape, and mask in the fourth embodiment, showing how the protective tape is made nonuniform in adhesive strength after being pasted to the recording head.
Figure 7:
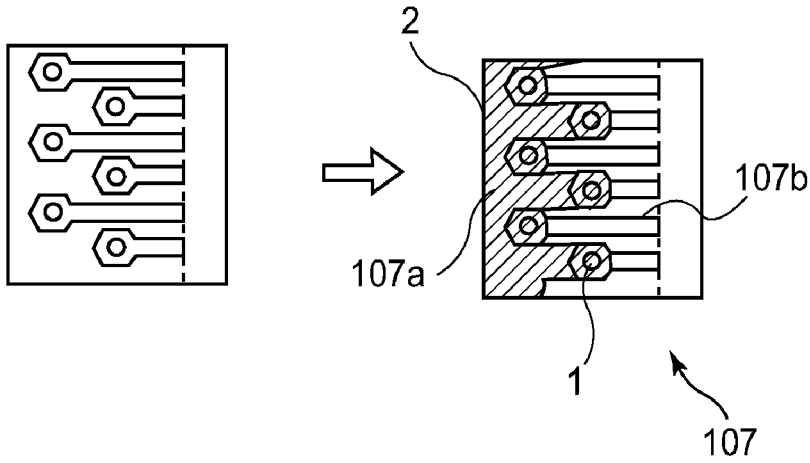

FIG. 7 is a drawing which depicts the fourth embodiment of the present invention. FIG. 7(*a*) is a perspective view of the recording head 108 and the protective tape 107 on the recording head, in which the liquid jetting orifices, and their adjacencies, are exaggerated to clearly show the distinction between the portion 107*a* of the protective tape 107, that is, the portion next to the liquid jetting orifices, which is greater in adhesive strength, and the portions 107*b* of the protective tape 107, that is, the rest, which are less in adhesive strength. FIG. 7(*b*) is a plan view of the left half of the recording head 108. In FIG. 7(*a*), the portion of the protective tape 107, which is relatively high in adhesive strength, is diagonally hatched and is designated with a referential character 107*a*, and the portion of the protective tape 107, which is relatively low in adhesive strength, is also diagonally hatched, but differently from the portion 107*a*, and is designated with a referential character 107*b*. The other features of the ink jetting head 108 and protective tape 107, and the method used for processing the protective tape 107, are similar to those in the first embodiment.

In this embodiment, the ink jetting orifices are arranged in a zig-zag pattern (ink jetting orifices are arranged in multiple straight lines so that ink jetting orifices in one line are deviated by a preset distance in direction parallel to the other line of ink jetting orifices), and the protective tape 107 is processed so that the pattern in which the protective tape 107 is changed in adhesive strength matches the ink jetting orifice arrangement pattern. More specifically, the protective tape 107 is pasted to the recording head 108 which has the multiple ink jetting orifices arranged in the zig-zag pattern, and the protective tape 107 on the recording head 108 is changed in adhesive strength by projecting light on the protective tape 107 with the presence of a mask between the light source and the protective tape 107. The mask in this embodiment is different from that in the first embodiment, in the shape and position of the slits for changing the preselected portions of the protective tape 107 in adhesive strength. With the use of the process described above, the diagonally hatched portion 107*a* of the protective tape 107, which corresponds to the portions B and D of the recording head 101 in the first embodiment, remained unchanged, being therefore increased in adhesive strength in relative terms, whereas the diagonally hatched portion 107*b* of the protective tape 107, which corresponds to the portions E and F of the recording head 101 in the first embodiment was reduced in adhesive strength.

The pattern in which the protective tape 107 is changed in adhesive strength can be changed by changing, in shape and position, the slits of the mask, which determine the portions of the protective tape, which are irradiated with light. Therefore, even if the pattern in which the ink jetting orifices are arranged is complicated, the protective tape 107 can be changed in the adhesive strength so that the pattern in which the protective tape 107 is changed in adhesive strength matches the pattern of the ink jetting orifice arrangement. For example, even if the protective tape 107 is pasted on the recording head 108 which has multiple ink jetting orifices arrange in a zig-zag pattern, the protective tape 107 can be processed so that its adhesive strength changes in such a pattern that matches the ink jetting orifice arrangement pattern of the recording head. Therefore, it is possible to prevent the portion of the recording head 108, which is inferior in mechanical strength, from being damaged when the protective tape 107 is peeled.

Further, the portion 107*a* of the protective tape 107, which is on the areas of the top surface of the top plate of the recording head 108, which are next to the ink jet orifices, was left unchanged in adhesive strength, that is, it remains relatively high in adhesive strength. Therefore, each of the ink jetting orifices of the recording head 108 remains completely sealed with the portion of the protective tape 107, which is relatively high in adhesive strength. Therefore, it is possible to prevent ink from flying out of the ink jetting orifices. Therefore, it is possible to provide a recording head, which does not suffer from the problem that ink flies out of an ink jetting orifice, enters an ink jetting orifice which is different in the color of the ink therein, and mixes with the ink in this jetting nozzle. In other words, it is possible to provide a recording head in which the various inks in the recording head remain separated prior to the first time usage of the ink jet recording head.

MISCELLANIES

The present invention is effectively applicable to both an ink jet recording head independent from an ink container, and an ink jet recording head which is an integral part of an ink jet cartridge, that is, an integral combination of an ink jet head and an ink container. Further, the present invention is compatible with ink of any type, as long as the selected ink is an ordinary ink used by an ordinary ink jet recording apparatus.

As the material for the substrate of the protective tape in accordance with the present invention, any substance can be used, as long as the selected substance does not interfere with the process of changing the excitation of the adhesive of the protective tape, and it allows the protective tape to be easily peeled. However, in consideration of such factors as the compatibility of the selected substance with the patterning process, and how easy it is to peel the protective tape, the thickness of the substrate is desired to be no more than 100 μm, preferably, no more than 50 μm.

Further, as the material for the substrate of the protective tape, any substance can be used, as long as the selected substance is low in gas permeability and resistant to ink. Further, in the preceding embodiments of the present invention, the means for generating the energy for jetting ink as recording liquid was a heat generating element. However, the application of the present invention is not limited to a recording apparatus, the means of which for generating the energy for jetting ink is a heat generating element.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 130789/2006 filed May 9, 2006 which is hereby incorporated by reference.

What is claimed is:

1. A liquid ejection head comprising:

an ejection side surface;

an ejection outlet, formed in said ejection side surface, for ejecting liquid; and a protection tape pasted on said ejection side surface, wherein said protection tape is partly irradiated with ultraviolet radiation or infrared radiation after being pasted on said ejection side surface such that bonding strength is different depending on a position of said protection tape.

2. A liquid ejection head according to claim 1, wherein the bonding strength is different depending on a local strength of a member constituting said ejection side surface.

3. A liquid ejection head according to claim 1, wherein a portion with a relatively high bonding strength includes an area around said ejection outlet.

4. A liquid ejection head according to claim 1, further comprising a liquid flow path which is in fluid communication with said ejection outlet and which is provided behind said ejection side surface, and a common liquid chamber, and the common liquid chamber is in fluid communication with said liquid flow path and is provided behind said liquid flow path.

5. A liquid ejection head according to claim 4, wherein a portion with a relatively low bonding strength includes an area behind which said common liquid chamber is provided.

6. A liquid ejection head according to claim 1, wherein the bonding strength is lowered by irradiation of the ultraviolet radiation.

7. A liquid ejection head according to claim 1, wherein the bonding strength is lowered by irradiation of the infrared radiation.

8. A liquid ejection head according to claim 1, wherein said protection tape is irradiated with the ultraviolet radiation or infrared radiation through a mask.

9. A liquid ejection head according to claim 1, wherein said protection tape includes a base material and an adhesive material, wherein said base material has a thickness of not more than 100 μm.

10. A liquid ejection head according to claim 1, wherein said liquid ejection head is comprised of an ink jet cartridge with a container accommodating the liquid to be ejected through said ejection outlet.

11. A protection tape pasting method comprising:

a step of preparing an ejection side surface, defining an ejection outlet for ejecting liquid;

a step of pasting a protection tape on the ejection side surface; and a step of exciting the protection tape by partly irradiating the protection tape with ultraviolet radiation or infrared radiation, after said pasting step, to provide a bonding strength which is different depending on a position of the protection tape.

12. A pasting method of pasting a protection tape on an ejection side surface having an ejection outlet for ejecting liquid, said method comprising:

a step of applying adhesive material having a bonding strength which is lowered by irradiation with ultraviolet radiation;

a step of pasting the protection tape on the ejection side surface;

a step of covering the protection tape with a mask having an opening in a predetermined position; and a step of irradiating the protection tape with ultraviolet radiation through the mask.

13. A pasting method of pasting a protection tape on an ejection side surface having an ejection outlet for ejecting liquid, said method comprising:

a step of applying adhesive material having a bonding strength which is lowered by irradiation with infrared radiation;

a step of pasting the protection tape on the ejection side surface;

a step of covering the protection tape with a mask having an opening in a predetermined position; and a step of irradiating the protection tape with ultraviolet radiation through the mask.

14. A method according to claim 12 or 13, wherein the opening of the mask is formed adjacent the ejection outlet.

15. A method according to claim 12 or 13, wherein the opening of the mask is formed adjacent a liquid flow path.

* * * * *